United States Patent [19]

Strindehag et al.

[11] 4,038,059

[45] July 26, 1977

[54] HUMIDITY AND HEAT EXCHANGER APPARATUS, AND METHOD FOR ITS MANUFACTURE

[75] Inventors: Ove Strindehag; Erik Wrangel, both of Jonkoping, Sweden

[73] Assignee: Aktiebolaget Svenska Flaktfabriken, Nacka, Sweden

[21] Appl. No.: 651,589

[22] Filed: Jan. 22, 1976

[30] Foreign Application Priority Data

| | | |
|---|---|---|
| Jan. 30, 1975 | Sweden | 7500987 |
| Nov. 24, 1975 | Sweden | 7513148 |

[51] Int. Cl.[2] ..... B01D 53/16

[52] U.S. Cl. ..... 55/388

[58] Field of Search ..... 55/33, 34, 208, 388, 55/390; 62/94, 271; 165/7

[56] References Cited

U.S. PATENT DOCUMENTS

| | | | |
|---|---|---|---|
| 2,792,071 | 5/1957 | Pennington | 55/34 X |
| 3,176,446 | 4/1965 | Siggelin | 55/34 X |
| 3,572,008 | 3/1971 | Hankison et al. | 55/33 |
| 3,708,956 | 1/1973 | Norback | 55/34 X |
| 3,733,791 | 5/1973 | Dravnieks | 55/390 |

*Primary Examiner*—Frank A. Spear, Jr.
*Assistant Examiner*—Robert H. Spitzer
*Attorney, Agent, or Firm*—Howson and Howson

[57] ABSTRACT

The transfer elements of the rotor of a regenerative heat and humidity exchanger are made of a non-hygroscopic material, such as aluminum, the surface of which is treated to form a hygroscopic layer thereon. This provides the benefits in humidity transfer previously obtained with all-hygroscopic transfer elements such as paper, cardboard or asbestos, without the danger of fire in the use of paper or cardboard or the danger to health in the use of asbestos. Preferably the transfer element is of metal on which a hygroscopic surface layer is formed by oxidizing the surface by pickling and/or heat treatment, and preferably the oxide layer is impregnated with a substance, e.g. lithium chloride, to render it more hygroscopic. Preferably also, the layer is made more porous by acid treatment prior to oxide formation, and acid treatment may be used after the pickling process to arrest the pickling reaction promptly.

6 Claims, 3 Drawing Figures

HUMIDITY AND HEAT EXCHANGER APPARATUS, AND METHOD FOR ITS MANUFACTURE

This invention relates to humidity and heat exchanger apparatus, particularly those of the regenerative type, and to methods for the manufacture thereof.

Regenerative heat exchangers have long been used to recover heat in ventilation installations because such heat exchangers exhibit a comparatively high degree of thermal efficiency. Regenerative heat exchangers in addition can achieve an effective transfer of humidity, which can be especially valuable in zones with a cold climate. The most frequently used type of regenerative heat exchanger hitherto used in ventilation installations to transfer heat from the warm discharge air flow to the cold intake air flow is a rotating heat exchanger with a disc-shaped rotor. The heat exchanger rotor is usually constructed of alternating flat and corrugated metal, paper, cardboard or asbestos panels or foils. In another standard model, the rotor is constructed of a three dimensional network of metal wires.

In the case of rotating heat exchangers whose heat exchange body consists of panels or a network made of non-hygroscopic material, for example of metal, humidity transfer hitherto came about only as a consequence of water vapor condensation. Such heat exchangers thus accomplish a less efficient transfer of humidity than exchangers constructed of hygroscopic material, for example paper or asbestos. However, heat exchangers with metal rotors possess the clear advantage over rotors made of paper of the like, in that they are fire-proof and further because the use of metals in ventilation installations is, for medical reasons, preferable to the use of asbestos.

The object of the present invention thus is to provide a regenerative humidity and heat exchanger which is fire-proof and safe from a medical point of view, and which possesses efficient heat and, especially, humidity, transfer characteristics.

This task is accomplished according to the invention by the regenerative humidity and heat exchanger and method of its manufacture described in the following detailed description and covered by the appended claims. The invention results in an efficient transfer of humidity without jeopardy to fire safety or to medical requirements, resulting in improvement over heat exchangers of hitherto standard construction.

DETAILED DESCRIPTION OF SPECIFIC EMBODIMENTS

A heat exchanger body according to the invention, can be constructed in a number of different ways. The application of the surface treatment process involved in preferred forms of the invention will be described herein by way of example only in connection with a usual case in which the heat exchanger body consists of a rotor constructed of alternating flat and corrugated foils joined together by glue or by adhesives. This embodiment is evident from FIGS. 1–3, wherein.

If, besides other factors, we consider weight, workability and durability in humid air, then aluminum is a suitable metal for heat exchanger construction and the surface treatment process described in this connection thus applies especially to aluminum or to aluminum alloy. But it is also stressed that the invention is in no case limited to these materials, and that the idea of the invention, and the following patent claims, include also any other suitable non-hygroscopic rotor material. We further assume by way of example that flat or corrugated panels, foils, etc. are used for the construction of the heat exchanger body which, being furnished with special spacing arrangements, creates continuous channels leading through it. By treating the flat and/or corrugated foils or the like on both sides, the area of the humidity transfer surface of the heat exchanger body becomes equal to that of the heat exchange surface, which means that only small amounts of humidity need be absorbed or released per unit of area. Normally humidity is absorbed in a warm, and released in a cold, air stream. The circumstance that the amounts of humidity transferred per unit area can be small permits the use of thin hygroscopic layers on a non-hygroscopic substrate, e.g. an aluminum panel or foil.

The hygroscopic coating of the aluminum panels or foils constituting the heat exchanger body is, in line with the invention, achieved by treating them first in a pickling bath which is followed by a heat treatment until a thin layer of aluminum oxide forms. This layer, hygroscopic in itself, is utilized to retain the required quantities of a hygroscopic salt, for example of lithium chloride. The addition of an adequate quantity of the hygroscopic salt will result in the humidity transfer desired, i.e. improve humidity retaining ability.

The pickling bath for the surface treatment of the aluminum elements used in one mode of construction of the heat exchanger body, consists of a 3–10 percent, preferably a 5 percent solution of sodium hydroxide, kept at a 70° C temperature during the picking process. Immediately after pickling, the aluminum elements or the entire heat exchanger body is heat-treated in moist air at a temperature of 110° C. Heat treatment should last for at least 30 minutes to obtain an adequately thick oxide layer. This will yield a surface layer of a thickness which will retain a sufficient quantity of the hygroscopic salt. When lithium chloride is used as the hygroscopic salt, when the salt coating required by regenerative humidity and heat exchangers for ventilation is about 1g per sq. m.

Figure 1:
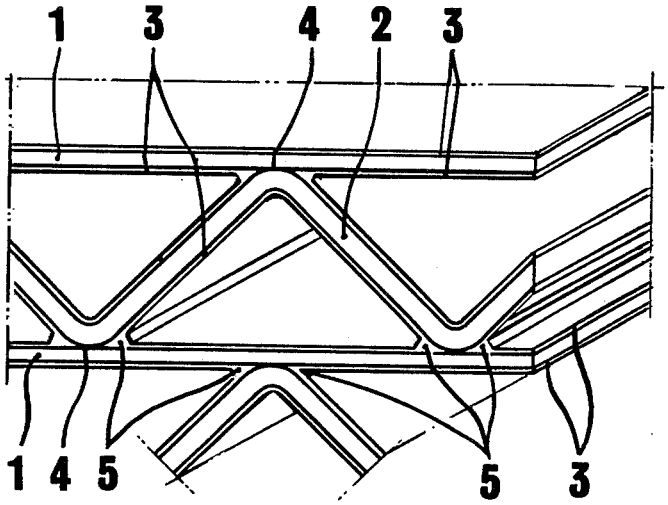
FIG. 1 is an enlarged fragmentary side view of a portion of the rotor of FIG. 3, constructed of alternating flat and corrugated foils.
Figure 2:
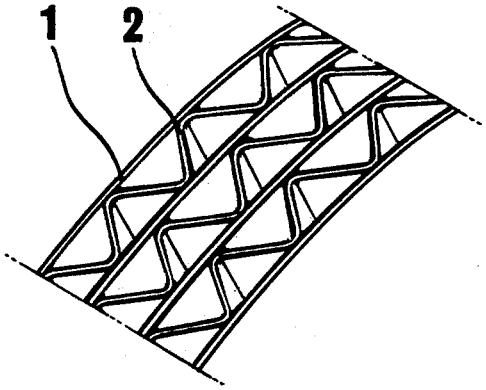
FIG. 2 is a less-enlarged fragmentary view of a larger segment of the same rotor.
Figure 3:
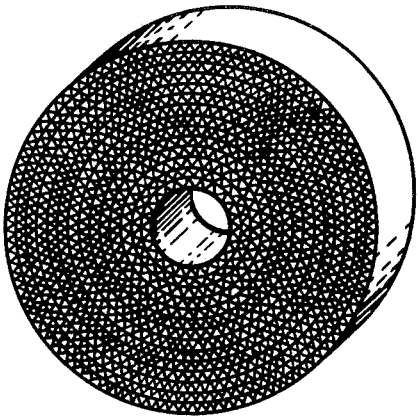
FIG. 3 is a perspective view of the entire rotor.

FIG. 1 reveals tht the flat foils 1 and the corrugated foils 2 are coated on both sides with the surface layer 3. The flat foils were glued to the corrugated ones at contact points 4, yielding a mechanically stable rotor. In the case of the model shown it is assumed that the surface treatment took place after the assembly or the heat exchanger body, which is why no surface layer formed on the parts of the foils where joints 5 are glued on. Usually very compact rotor structures are chosen for rotating heat exchangers, and rotors constructed of alternating flat and corrugated foils are so spaced that the distance between the center lines of the flat foils is usually 1–3 mm. The flat and corrugated foils are usually 0.05–0.2 mm. thick.

Before the oxidation of the opposite sides of the foils or of similar elements by pickling and/or by heat treatment, it is advantageous to render the outer surface porous by chemical treatment, preferably by an acid. The thickness of the porous layers is adjusted to the desired degree of humidity transfer, and the layers can be made so thick that continuous traversing capillaries form. A diluted acid bath is preferable. Different acids can be used for this purpose, and the treatment can also be carried out with more than one kind of acid in one bath or in several different baths. Hydrochloric acid of 2–10 percent concentration, preferably of 5 percent concentration, can be named as an example of a suitable acid.

When the foils or similar elements are to be pickled, it is advantageous to arrest the reaction after completion of the treatment in the pickling bath quickly by a follow-up treatment in acid, for example in hydrochloric acid and water of the above concentration.

Oxidation of the outer surface of the foil or of a similar element can also be accomplished only by heat treatment. Irrespective of whether this treatment is administered as described above or only as a supplemental treatment, it can be carried out at a high temperature in moist air or in water. The formation of an oxide layer by heat treatment in moist air is preferably accomplished at a temperature about 50° C and at a relative humidity about 10 percent. The formation of an oxide layer by heat treatment in watershould preferably take place at a water temperature exceeding 35° C.

The oxidation of the aluminum surfaces can thus be accomplished after they have been rendered porous in the manner described. Impregnation with a hygroscopic salt through immersion in a weak aqueous solution of the salt in question can then be carried out.

The pickling bath to be used for the oxidation of the aluminum surfaces by chemical treatment can advantageously contain sodium hydroxide or sodium carbonate of 1–10 percent concentration, preferably 5 percent. The bath should have a temperature of 25°–75° C, preferably 50° C.

To obtain a sufficiently thick oxide layer it is advantageous to supplement chemical treatment by the heat treatment described above.

It is advantageous to use sodium hydroxide and water as a pickling bath for the aluminum surfaces with a 0.2–10 percent sodium hydroxide concentration, preferably 0.2–3 percent.

The described embodiments represent merely nonlimiting examples, which can be changed or supplemented at will, or arranged in a desired manner within the scope of the concept of the invention and of the following claims.

Related subject matter is disclosed and claimed in my copending application Ser. No. 651,588, filed concurrently herewith, and entitled Humidity and Heat Exchanger Apparatus.

What is claimed is:

1. In regenerative humidity and heat exchanger apparatus comprising transfer elements having hygroscopic surfaces movable into heat and humidity exchange alternately with two different zones of fluid, the improvement wherein each of said transfer elements comprises an interior body portion of non-hygroscopic oxidizable metal having an exposed oxidized surface layer formed therefrom to provide an integral hygroscopic metal oxide surface for said transfer element.

2. The apparatus of claim 1, in which said oxide layer is impregnated with a further material to enhance its hygroscopic characteristics

3. The apparatus of claim 2, in which said further material is lithium chloride.

4. The apparatus of claim 1, in which said metal is aluminum and said oxide layer comprises aluminum oxide.

5. The apparatus of claim 4, in which said oxide layer is impregnated with a further material to enhance its hygroscopic characteristics.

6. The apparatus of claim 5, wherein said further material is lithium chloride.

* * * * *